US006236367B1

(12) United States Patent
Du Toit et al.

(10) Patent No.: US 6,236,367 B1
(45) Date of Patent: May 22, 2001

(54) DUAL POLARISED PATCH-RADIATING ELEMENT

(75) Inventors: Cornelis Frederik Du Toit, Wellington; Mathias Martin Ernest Ehlen, Upper Hutt; Richard John Hutchinson; John Heywood Thomson, both of Wellington, all of (NZ)

(73) Assignee: Deltec Telesystems International Limited, Wellington (NZ)

( * ) Notice: Subject to any disclaimer, the term of this patent is extended or adjusted under 35 U.S.C. 154(b) by 0 days.

(21) Appl. No.: 09/160,914

(22) Filed: Sep. 25, 1998

(51) Int. Cl.[7] ..... H01Q 1/38

(52) U.S. Cl. ..... 343/700 MS; 343/817; 343/829

(58) Field of Search ..... 343/700 MS, 829, 343/846, 834, 815, 816, 817, 818, 848; H01Q 1/38

(56) References Cited

U.S. PATENT DOCUMENTS

| | | | | |
|---|---|---|---|---|
| 4,903,033 | * | 2/1990 | Tsao et al. | 343/700 MS |
| 5,008,681 | * | 4/1991 | Cavallaro et al. | 343/700 MS |
| 5,200,756 | * | 4/1993 | Feller | 343/700 MS |
| 5,241,321 | | 8/1993 | Tsao | 343/700 MS |
| 5,471,221 | * | 11/1995 | Nalbandian et al. | 343/700 MS |
| 5,734,350 | * | 3/1998 | Deming et al. | 343/700 MS |
| 5,949,376 | * | 9/1999 | McDonald et al. | 343/700 MS |

FOREIGN PATENT DOCUMENTS

| | | |
|---|---|---|
| 16207/97 | 9/1997 | (AU) . |
| 2 685 130 | 6/1993 | (FR) . |
| WO 91/12637 | 8/1991 | (WO) . |

OTHER PUBLICATIONS

Jun. 1998, Australian Patent Office International—Type Search Report.

* cited by examiner

*Primary Examiner*—Tho Phan
(74) *Attorney, Agent, or Firm*—Merchant & Gould P.C.

(57) ABSTRACT

A radiating element for dual polarised operation in a linear antenna array is disclosed. The radiating element is a dual polarised radiating patch element consisting of a ground plane, a lower patch, an upper patch and parasitic elements. The lower patch and upper patch are stacked above the ground plane in a spaced apart relationship. The parasitic elements lie in the same plane as the lateral edges of the lower patch. Supports are used to hold the patches and the parasitic elements in a spaced apart relationship. The parasitic elements are fed from a central area of the lower patch by microstrips. The ground plane has apertures which are of a dumbbell shape to achieve the same effective length as long apertures. Orthogonally disposed strip type driven elements span across the central portions of the apertures and the length of these strips is selected to achieve the desired matchings. The feed to the driven elements will typically form part of a feed network etched onto a PCB mounted adjacent to the ground plane with conducting elements facing away from the ground plane. One requirement of this device is that the return loss at each port must satisfy a certain minimum level over a given frequency band. This is satisfied by employing an aperture coupled stacked patched configuration. Another requirement is that isolation between the two ports has to satisfy a certain minimum allowed level which is achieved by obtaining almost perfuect symmetry in one plane. In order to narrow the beam width for the vertically polarised radiation parasitic elements are provided which are feed from a region located near the middle of the lower patch via microstrips.

28 Claims, 11 Drawing Sheets

PRIOR ART

DUAL POLARISED PATCH-RADIATING ELEMENT

Figure 1:
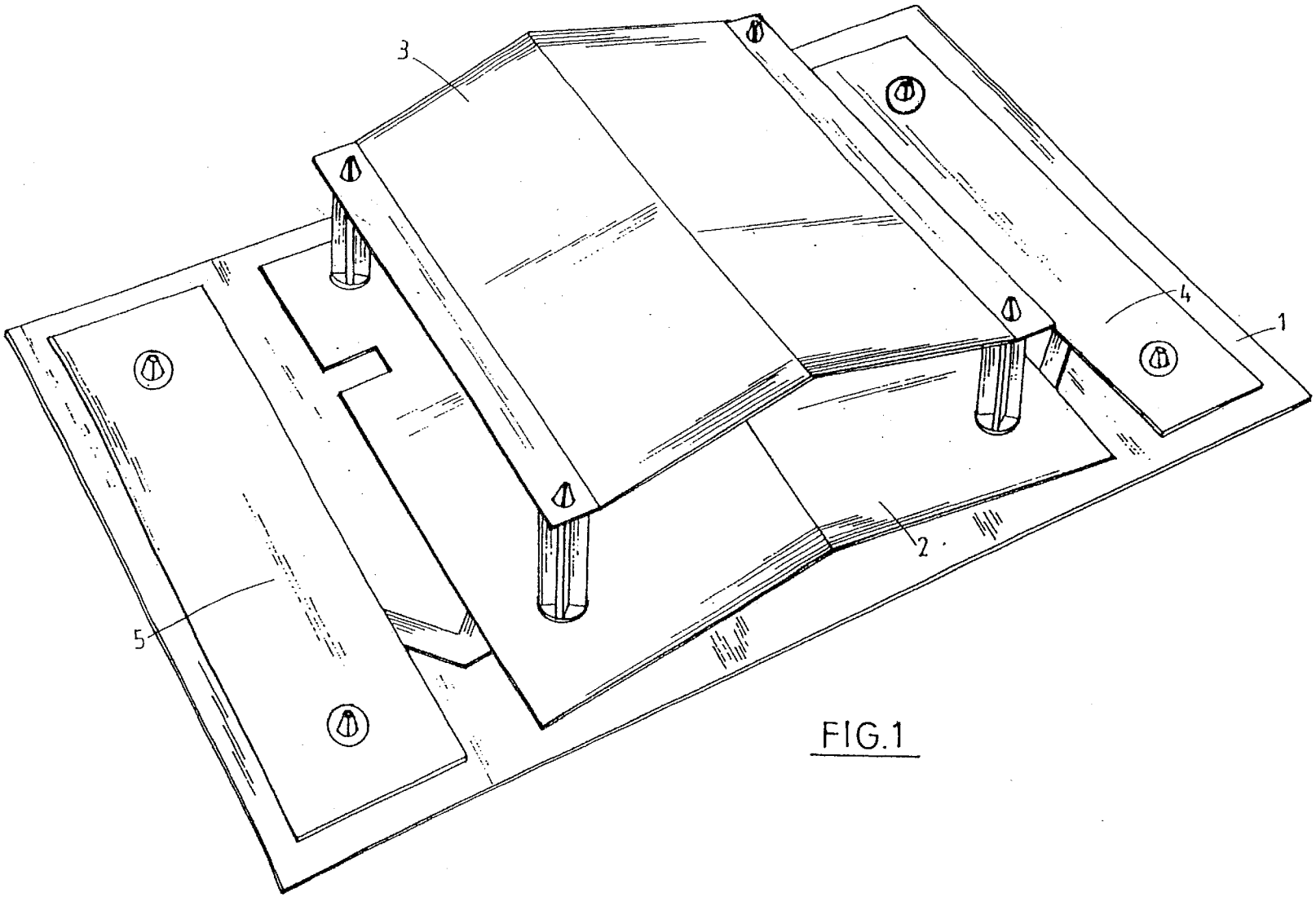

The present invention relates to a radiating element. Particularly, although not exclusively, the present invention relates to an aperture coupled, stacked patch-type radiating element suitable for dual polarised operation in a linear antenna array.

Usually, a dual polarised radiating patch element is realised by separately exciting two orthogonal resonant modes in a patch above a ground plane. In order to achieve similar operational characteristics for the two polarisations, and, most importantly, to achieve good isolation between the two ports, the patch and feed topology is usually chosen to have two orthogonal planes of symmetry, invariant under a rotation of 90°.

To widen the return loss bandwidth, the volume enclosing active current carrying parts and strongly coupled fields around the radiating element should be enlarged. In the case of a patch element, this can be achieved by raising the patch higher above the ground plane, and adding closely coupled parasitic patch elements. Parasitic elements adjacent to the main patch usually have profound effects on the radiation patterns, therefore a stacked patch configuration is usually preferred. Parasitic elements have been used to adjust band width rather than beam width. The effect of parasitic elements on the radiation pattern has been viewed as a problem with parasitic elements. A feed arrangement via an aperture in the ground plane provides a strongly coupled, non-contact connection between the feed network and the patch.

A dual polarised antenna element is driven from two ports, each port exciting one of the two orthogonal polarisations of the element. Three criteria must usually be met as follows:

1. The return loss at each port must satisfy a certain minimum level over a given frequency band.
2. The co- and cross-polarised radiation patterns associated with excitation of each of the two ports must satisfy certain specifications (i.e. co-polarised beam widths and side lobe levels, low cross-polarised radiation levels etc).
3. Isolation between the two ports must satisfy a certain minimum allowed level.

It is an object of the present invention to provide a patch-type radiating element allowing the beam width of the element to be easily adjusted or to at least provide the public with a useful choice.

According to a first aspect of the invention there is provided a patch-type radiating element including a non-planar patch shaped to produce a desired beam pattern when excited by the driven element.

The patch preferably has only first order symmetry and may consist of two planar portions disposed at an angle to one another. They may be disposed at an angle of between 178° and 135°, preferably between 175° and 150°.

In one preferred construction the patch-type radiating element is excited by two driven elements which excite two orthogonal resonant modes in the patch and wherein the plane of symmetry of the patch is aligned so that the beam width of one resonant mode is varied substantially more than the beam width of the other resonant mode. Preferably two or more stacked patches are employed, each successive patch being bent by an increased amount and aligned along the common plane of symmetry.

It will be appreciated that the above aspects may be employed individually or in combination as required.

According to a further aspect of the invention, there is provided a radiating element including a patch and auxiliary elements fed directly from a central region of the patch.

There is also provided a radiating element comprising: a ground plane; a first patch spaced apart from the ground plane; a second patch provided spaced apart from the ground plane and a first edge of the first patch; and a driven element provided between the first patch and the second patch being positioned to excite both the first patch and the second patch.

There is further provided a radiating element comprising: a first driven element, and a lower patch, driven by the first driven element, having notches in the edges thereof positioned to increase coupling with a first aperture.

The invention will now be described by way of example with reference to the accompanying drawings in which:

FIG. 1: shows a perspective view of a patch-type radiating element according to a first embodiment.

Figure 2:
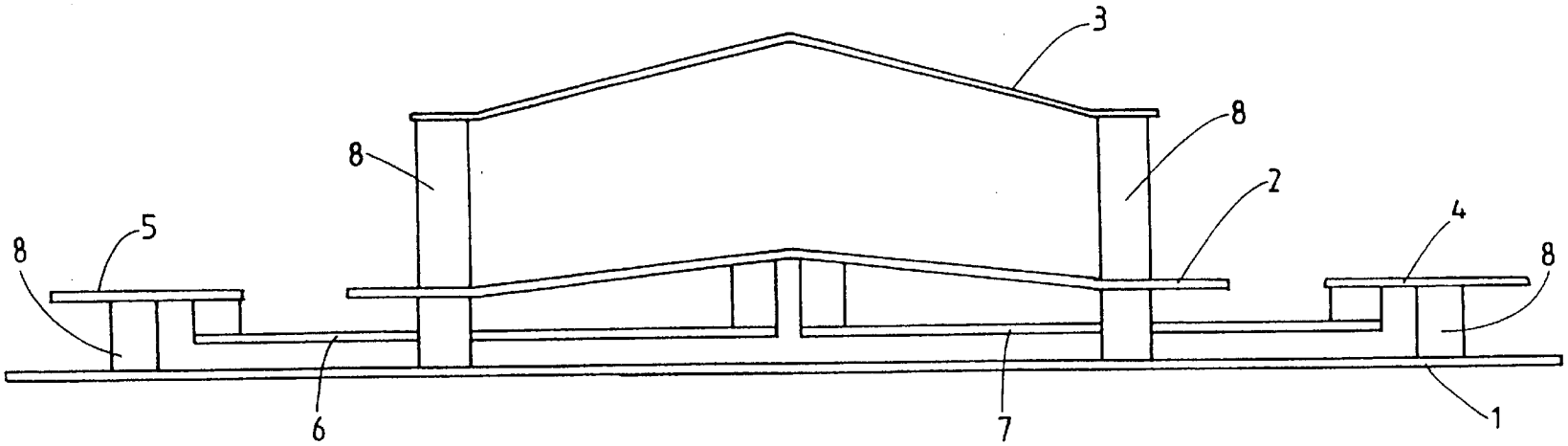

FIG. 2: shows an elevation of the radiating element shown in FIG. 1.

Figure 3:
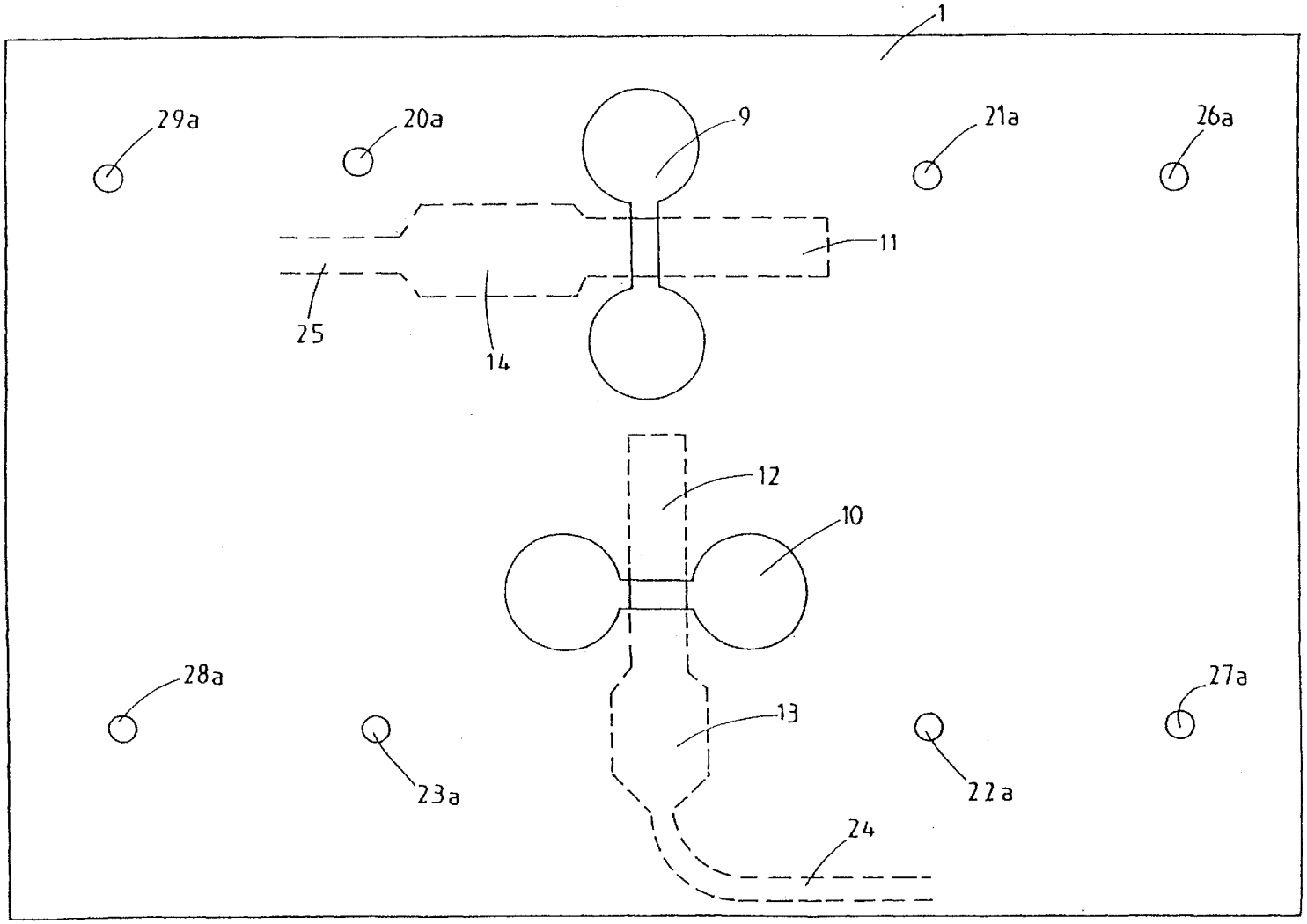

FIG. 3: shows the ground plane of the antenna shown in FIG. 1 with driven elements shown in dashed outline.

Figure 4:
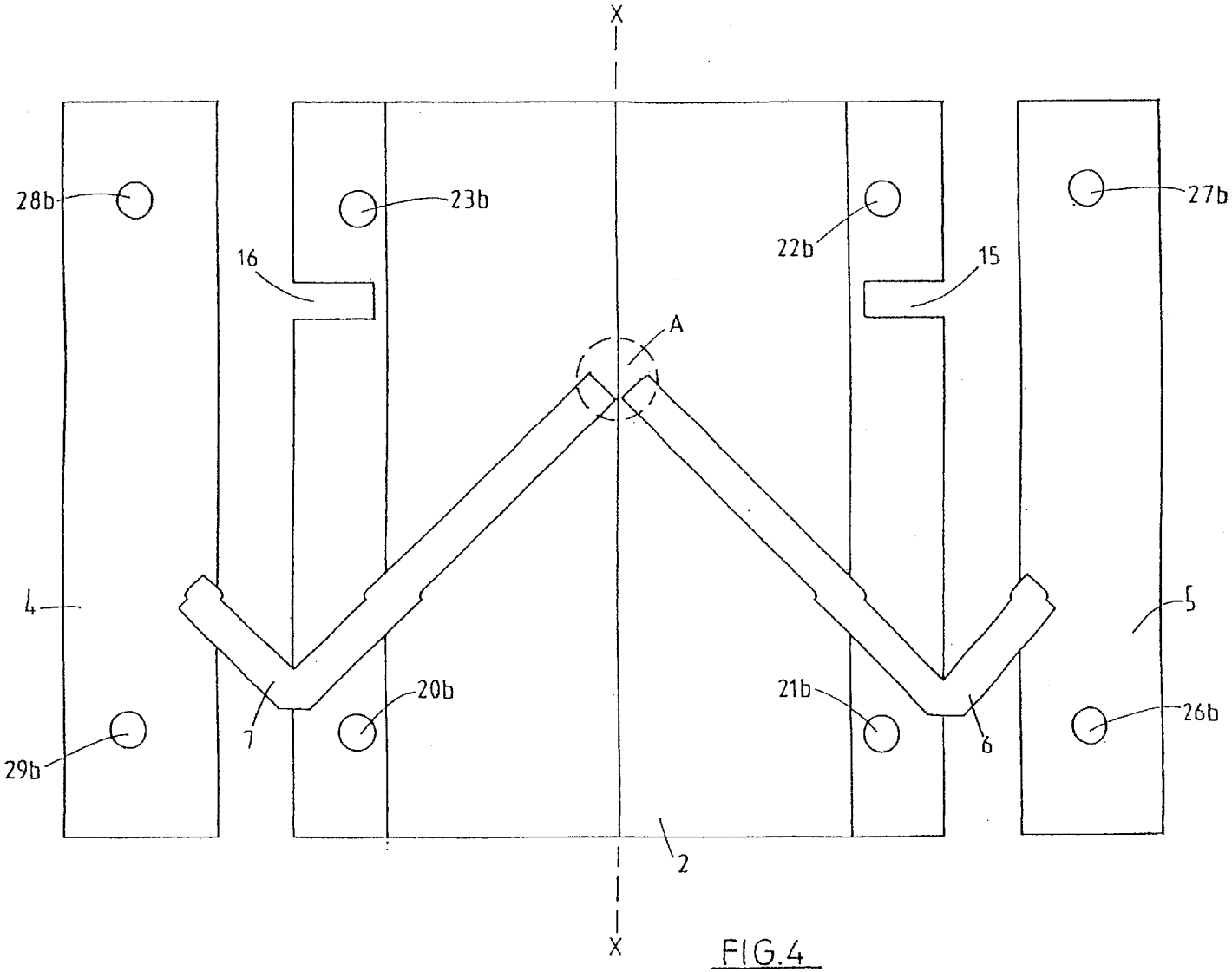

FIG. 4: shows a back view of the lower patch shown in FIG. 1.

Figure 5:
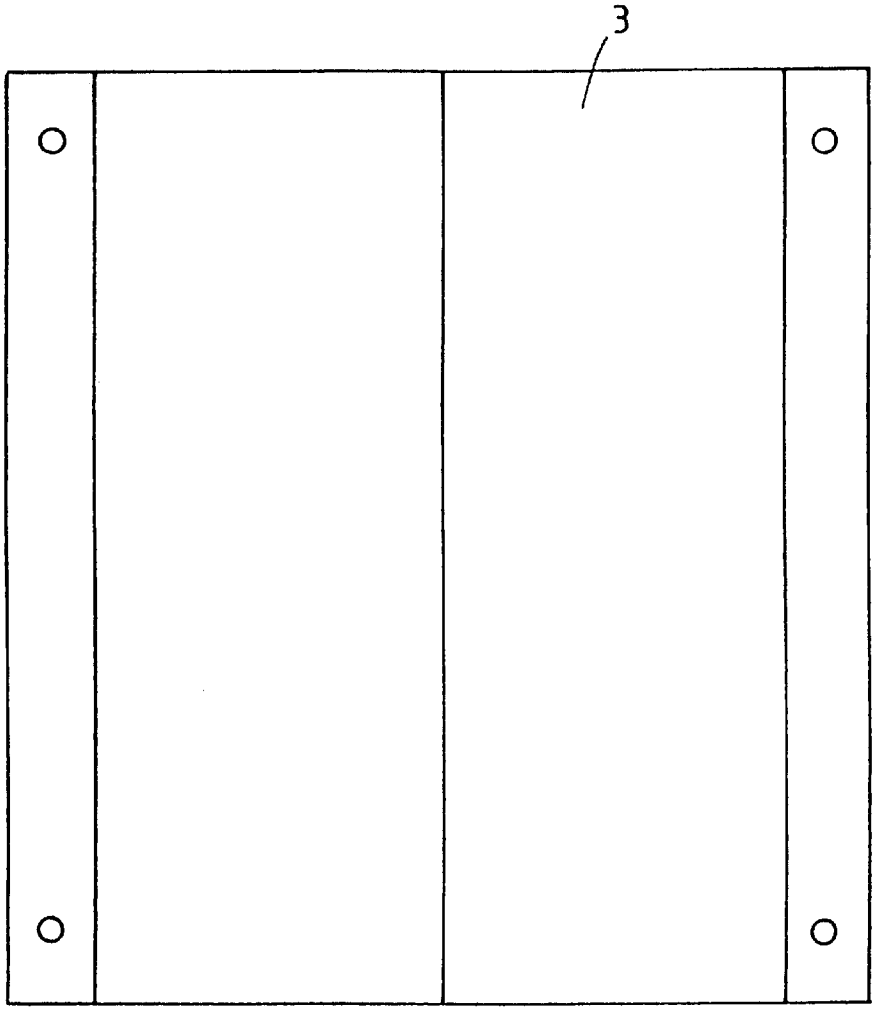

FIG. 5: shows a top view of the upper patch shown in FIG. 1.

Figure 6:
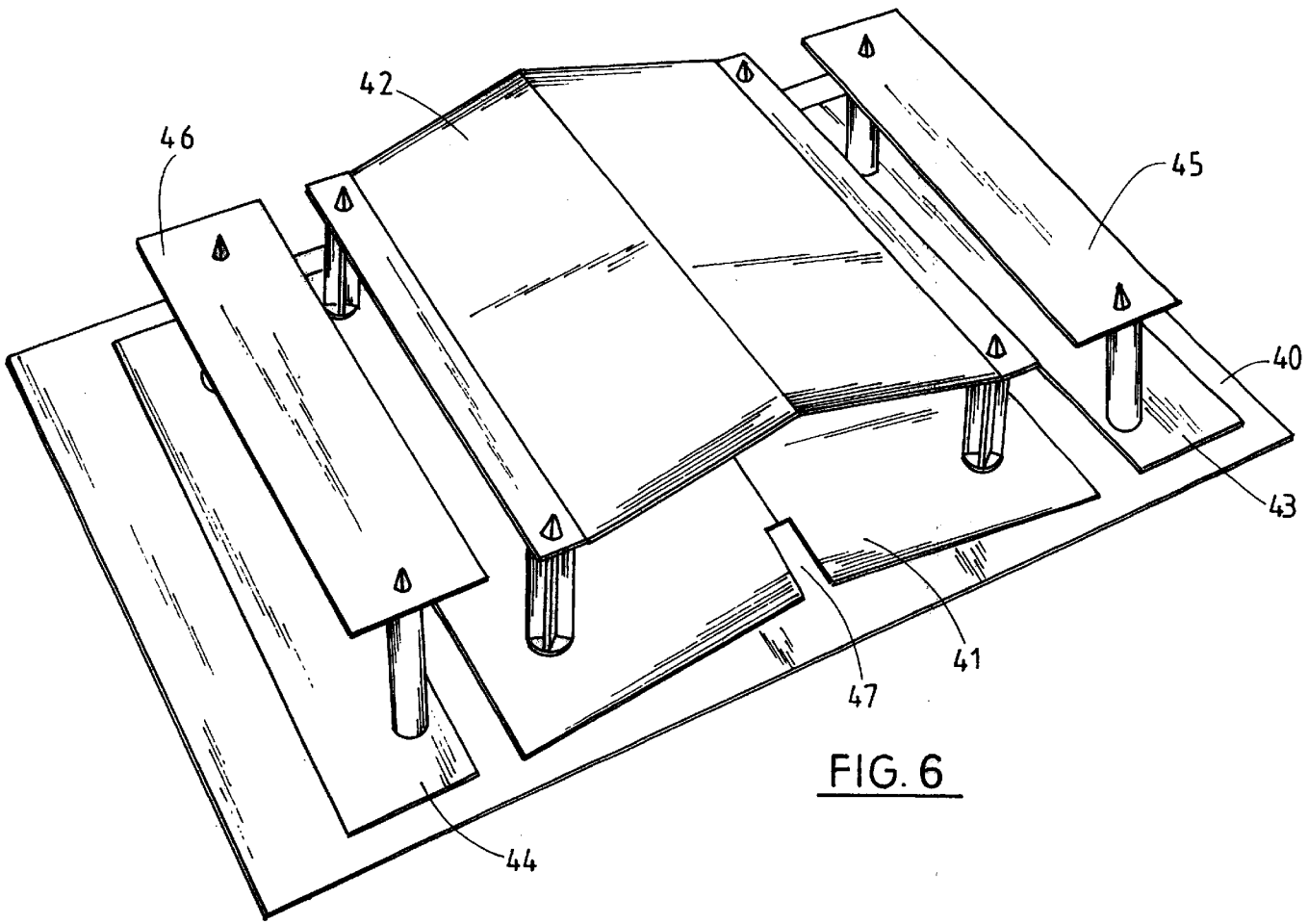

FIG. 6: shows a perspective view of a patch type radiating element according to a second embodiment.

Figure 7:
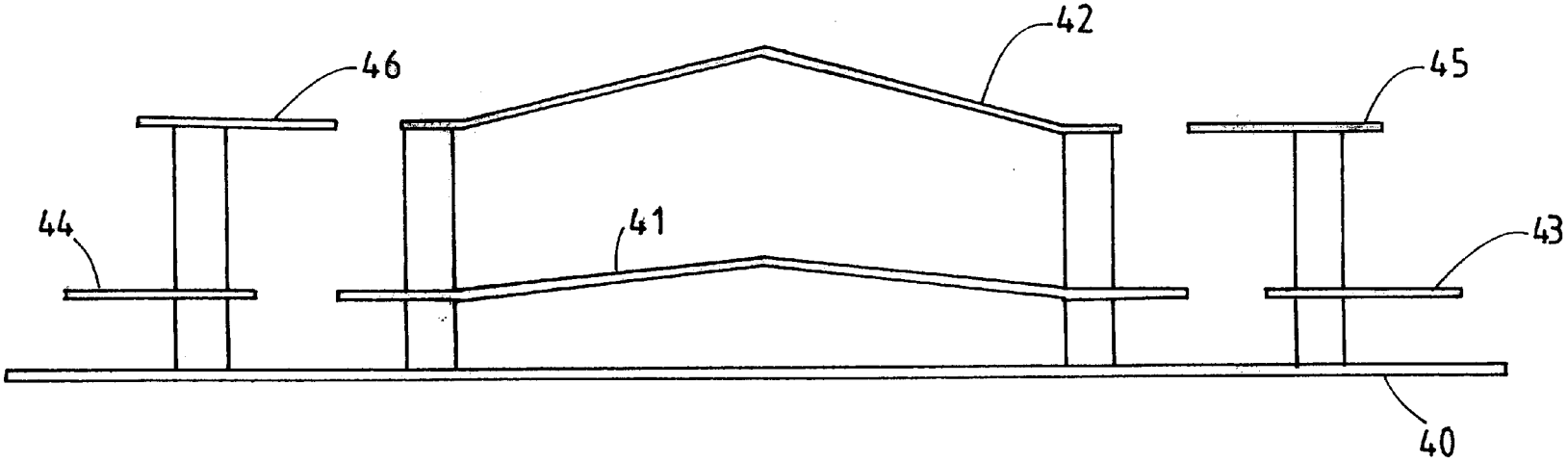

FIG. 7: shows an elevation of the radiating element shown in FIG. 6.

Figure 8:
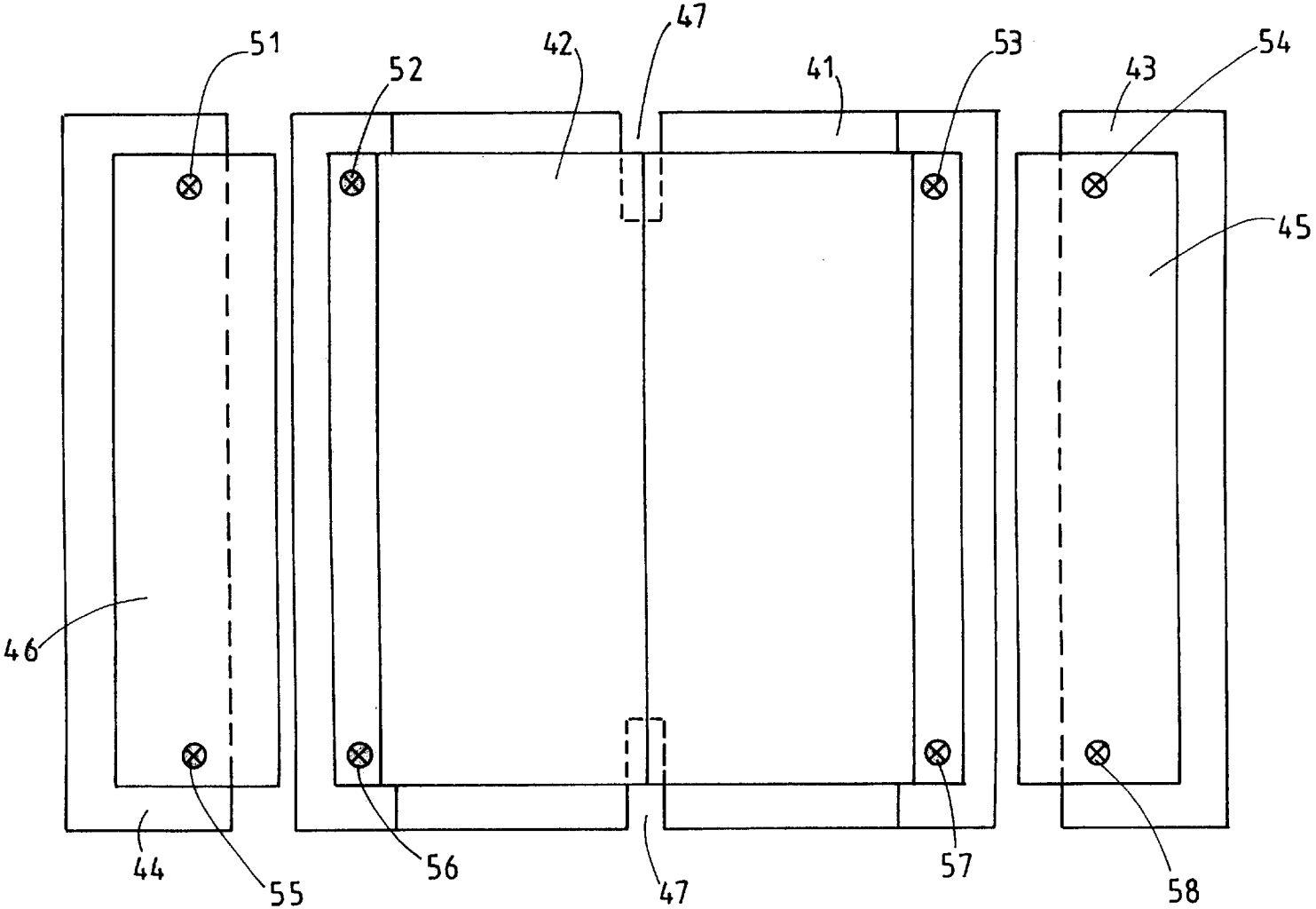

FIG. 8: shows a top view of the patch type radiating element shown in FIGS. 6 and 7.

Figure 9:
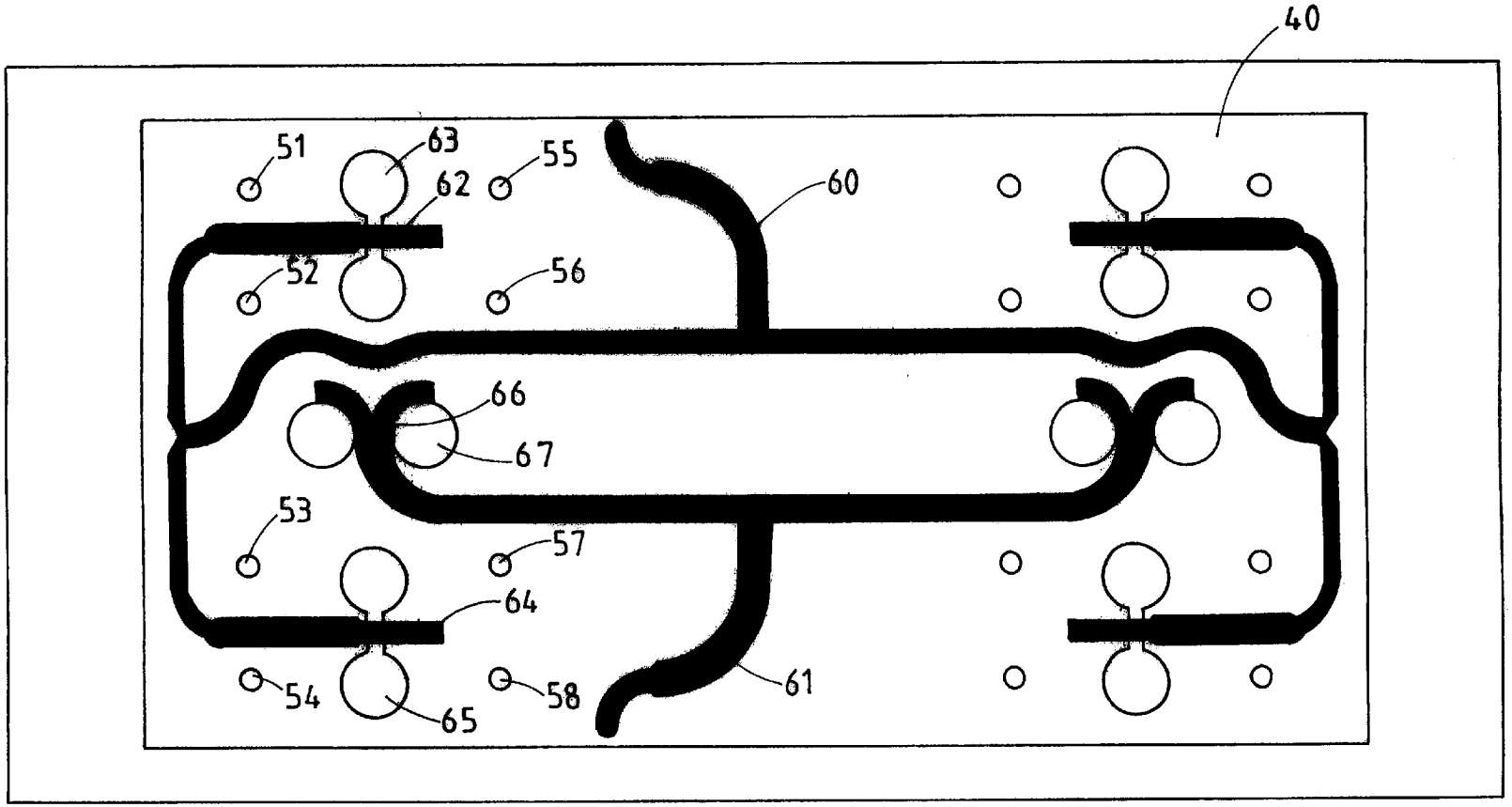

FIG. 9: shows an underside view of the ground plane and feed networks for the antenna shown in FIG. 6.

Figure 10:
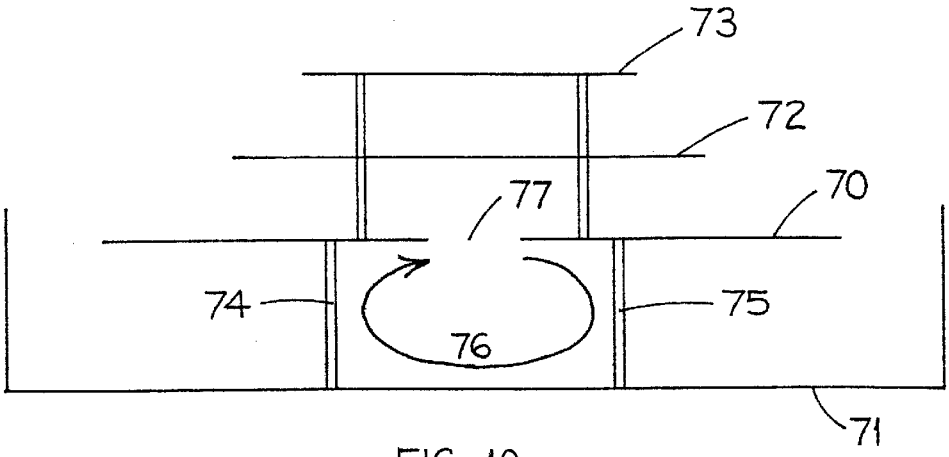

FIG. 10: shows a prior art shielding arrangement.

Figure 11:
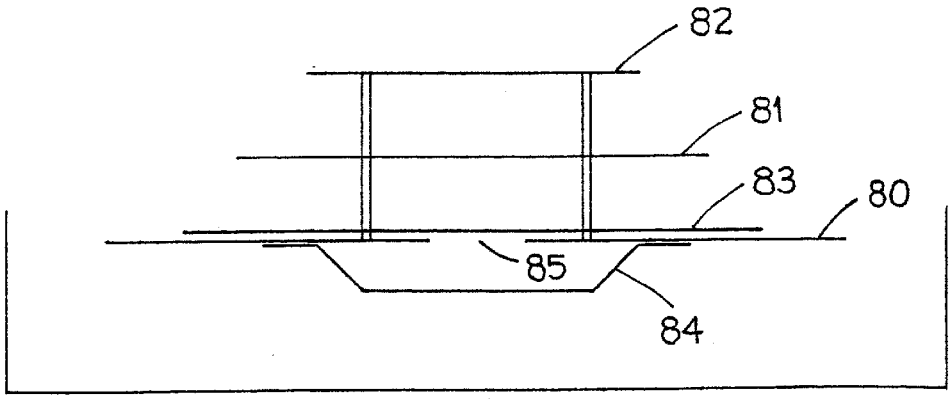

FIG. 11: shows a cross-sectional view of a radiating element including a shielding element according to the invention.

Figure 12:
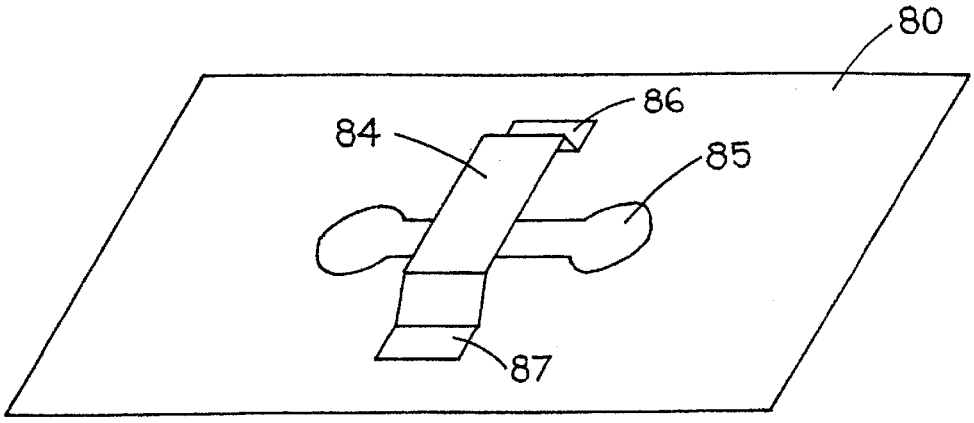

FIG. 12: shows an underside perspective view of the shielding element shown in FIG. 11.

Figure 13:
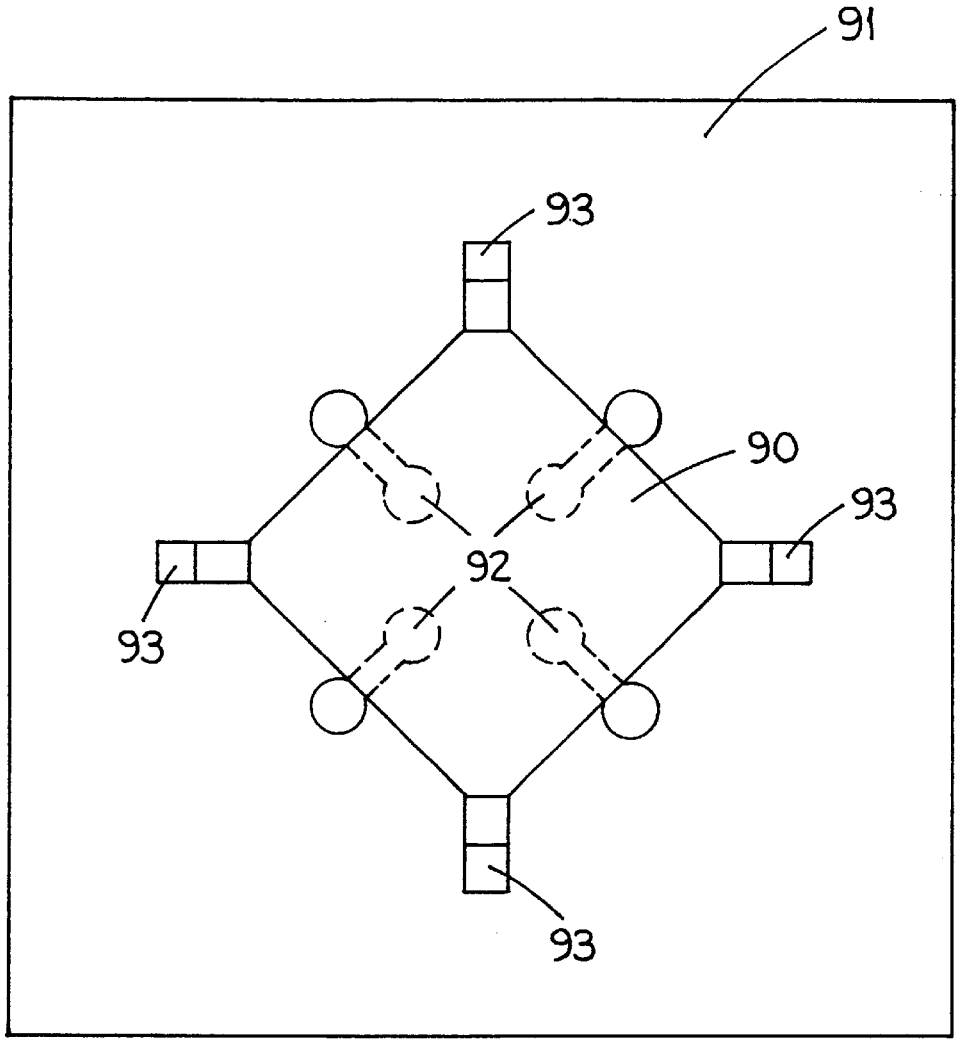

FIG. 13: shows a shielding element shielding multiple apertures.

FIG. 1 shows a dual polarised radiating patch element consisting of a ground plane 1, a lower patch 2, an upper patch 3 and auxiliary elements 4 and 5. As shown more clearly in FIG. 2 lower patch 2 and upper patch 3 are stacked above ground plane 1 in spaced apart relation. Auxiliary elements 4 and 5 lie in the same plane as the lateral edges of lower patch 2. The patches 2 and 3 and auxiliary elements 4 and 5 are held in spaced apart relationship by supports 8. Auxiliary elements 4 and 5 are fed from a central area A of lower patch 2 by microstrips 6 and 7 (as shown in FIG. 4).

Referring now to FIG. 3 the ground plane 1 is shown. Ground plane 1 has apertures 9 and 10 formed therein. The apertures 9 and 10 are of a "dumbell" shape so as to achieve the same effective length as longer apertures. Orthogonally disposed strip type driven elements 11 and 1 2 span across the central portions of apertures 9 and 10. The length of driven elements 11 and 12 is selected to achieve the desired matching. Matching elements 13 and 14 may also be provided. The feeds 24 and 25 to driven elements 11 and 12 are only partially shown as these will typically form part of a feed network etched on to a PCB mounted adjacent ground plane 1 with the conductive elements 11, 12, 13, 14, 24 and 25 facing away from ground plane 1.

To assemble the radiating element the lower patch shown in FIG. 4 is rotated forwards onto the ground plane 1 shown in FIG. 3 so that the apertures 20–23*a* and 26–29*a* are aligned with apertures 20–23*b* and 26–29*b*. Spacers 8 secure the lower patch above the ground plane at a required spacing.

Referring now to the three criteria mentioned in the introduction, each will be discussed in relation to the radiation element herein described.

The first requirement was that the return loss at each port must satisfy a certain minimum level over a given frequency band. This criterion is satisfied by employing an aperture coupled stacked patch configuration. Criterion 3 is that isolation between the two ports has to satisfy a certain minimum allowed level.

This is achieved by obtaining almost perfect symmetry in one plane. The patch, parasitic elements, and the ground plane apertures all conform to this symmetry, but the strips feeding the apertures from below the ground plane do not. Simulations and experiment have shown that this breach of symmetry still allows isolation of more than 35dB between the two ports.

To satisfy criterion 2, i.e. co-polarised beam widths, side lobe levels, low cross-polarised levels etc, certain innovations were required. The operation of the radiating element and, in particular, the innovations required are described below.

Driven elements 11 and 12 are driven via feeds 24 and 25 and each excites one of the two orthogonal polarisations in lower patch 2. The plane X—X referred to hereafter refers to a plane orthogonal to the plane of patch 2 along line X—X shown in FIG. 4. It was found that when the lower patch was a simple planar rectangular patch that the beam width of the vertically polarised radiation (polarisation aligned with plane X—X in FIG. 4) was too wide and that the beam width of the horizontally polarised radiation (radiation polarised orthogonal to plane X—X) was too narrow.

To narrow the beam width for the vertically polarised radiation auxiliary elements 4 and 5 were provided. Parasitic elements 4 and 5 are fed from region A via microstrips 6 and 7. Area A is located near the middle of lower patch 2 in the plane of symmetry X—X and so receives only a very small component of horizontally polarised current. The position of area A relative to the centre of lower patch 2 may be adjusted to achieve the desired amount of the vertically polarised current component to be supplied to auxiliary elements 4 and 5.

Microstrips 6 and 7 are preferably a half wave length long at the frequency of operation. A bend, as shown in FIG. 4, may be employed to obtain the desired length. Moving the point at which microstrips 6 and 7 connect to lower patch 2 (i.e. region A) varies the impedance at the source whereas moving the point of connection of microstrips 6 and 7 to the auxiliary elements 4 and 5 varies the load impedance.

Providing auxiliary elements 4 and 5 effectively broadens lower patch 2 for the vertically polarised components and thus narrows the beam width of the vertically polarised radiation.

To broaden the beam width of the horizontally polarised radiation patches 2 and 3 are bent along the plane of symmetry X—X as best shown in FIG. 2. Upper patch 3 is bent to a greater extent than lower patch 2. It will be appreciated that the inclined radiating surfaces change the n ear-field properties to broaden the propagating beam in the example shown. It will be appreciated that profiles other than the "roof top" form shown in FIG. 2 may be employed. For examples a curved profile could be employed. The "roof top" form is effective to broaden the beam width of the horizontally polarised radiation.

It will be appreciated that by suitable adjustment the desired beam width for vertically and horizontally polarised radiation may be achieved.

As the radiating element topology is not invariant under a 90° rotation, the input impedance loci for the two ports are not equal. It was found that for the port associated with the vertical polarisation, the coupling between the upper and lower patches was too strong compared to the coupling between the lower patch and the ground plane aperture 10, preventing the input impedance locus to conform to a low return loss figure. This situation was improved by providing slots 15 and 16 on the sides of the lower patch 2 in line with aperture 10 feeding this polarisation. Slots 15 and 16 were found to reduce the coupling between upper patch 3 and lower patch 2 and to increase coupling with aperture 10. This is because slots 15 and 16 force the currents more to the middle towards aperture 10.

Referring now to FIGS. 6 to 9 a radiating element according to a second embodiment is shown. This radiating element consists of a lower patch 41 and auxiliary elements 43 and 44 spaced apart from a ground plane 40; and an upper patch 42 and upper parasitic elements 45 and 46 spaced apart from lower patch 41 and auxiliary elements 43 and 44 respectively. In this embodiment auxiliary elements 43 and 44 are not fed via microstrips but are excited directly by driven elements.

FIG. 9 shows the feed network from the under side. By viewing FIG. 9 in conjunction with FIG. 8 and matching corresponding spacers 51 to 58 the relationship of the driven elements 62, 64 and 66 and patch 41 and auxiliary elements 43 and 44 can be determined.

As can be seen from the feed network shown in FIG. 9 the first signal is supplied to feed line 61 to drive driven element 66 located adjacent aperture 67. The apertures 63, 65 and 67 are dumb bell type apertures. Driven elements 66 excites patch 41 near the centre thereof to radiate a signal having a first polarisation.

A second signal is applied to feed network 60 which drives driven elements 62 and 64 at apertures 63 and 65 in ground plane 40. Driven elements 62 and 64 are aligned with the major axis of auxiliary elements 43 and 44 and are located between auxiliary elements 43 and 44 and lower patch 41. Driven elements 62 and 64 thus excite both auxiliary elements 43 and 44 and lower patch 41 in a mode of polarisation that is orthogonal to that excited by driven element 66.

In this arrangement slots 47 are located so as to increase the coupling, between the lower patch and aperture 67. By providing further parasitic elements 45 and 46 the band width of the radiating element can be increased and any undesired radiation caused by the microstrips used in the first embodiment can be avoided.

It will be appreciated that a linear antenna array may be constructed using a plurality of such radiating elements arranged in a line with the axis X—X of each element parallel with the array.

One undesirable effect of an aperture feed patch antenna is that a certain amount of radiation is directed backwardly and may radiate in undesired directions. One known solution is shown in FIG. 10. In this example a ground plane 70 is supported above a tray 71 and includes spaced apart patches 72 and 73. Metal posts 74 and 75 electrically connect areas of the ground plane adjacent aperture 77 to tray 71. This causes a circulating current 76 to flow through metal post 75, tray 71 and metal post 74 to minimise backwardly directed radiation. This approach has the disadvantage that it is time consuming during manufacture and makes it difficult to remove each radiating element from tray 71 as each metal post 74 and 75 must be disconnected from ground plane 70. It also requires good electrical connections between ground plane 70, metal post 74 and 75 and tray 71 to avoid intermodulations products in a multicarrier signal transmitter antenna.

An alternative approach according to the present invention is shown in cross section in FIG. 11. Patches 81 and 82 are shown stacked above ground plane 80. A printed circuit board 83 including the feed network and driven elements is secured on top of ground plane 80. Printed circuit board 83 may alternatively be provided on the underside of ground plane 80. A shielding element 84 in the form of a metal strip is connected from one side of ground plane 80 adjacent aperture 85 to another side of ground plane 80 adjacent the other side of aperture 85. The construction of the shielding element is best shown in the perspective underside view of FIG. 12.

The ends 86 and 87 of shielding element 84 may be connected to the ground plane 80 capacitively or electrically. The shielding element should be spaced apart from aperture 85 sufficiently to avoid shorting the aperture. The shielding element of the present invention consists of a single metal strip as opposed to the discrete metal posts 74 and 75 and tray 71 previously used. Manufacturing is thus simplified, cost is reduced and disassembly is simplified.

Referring now to FIG. 13 there is shown an arrangement in which a shield 90 is provided spaced apart from a ground plane 91 having four apertures 92 formed therein. Tabs 93 are electrically connected to ground plane 91 and support shielding element 90 above the ground plane. This illustrates how a single shielding element may shield multiple apertures simultaneously.

It will thus be seen that the present invention provides a patch-type radiating element meeting the operating criteria for a dual polarised antenna and allowing independent adjustment of the beam width for horizontally and vertically polarised radiation. Further, the invention provides means for adjusting the coupling between patches and the ground plane aperture.

Where in the foregoing description reference has been made to integers or components having known equivalents then such equivalents are herein incorporated as if individually set forth.

Although this invention has been described by way of example it is to be appreciated that improvements and/or modifications may be made thereto without departing from the scope or spirit of the present invention.

What is claimed is:

1. A radiating element including a non-planar patch and two driven elements arranged to excite two orthogonal resonant modes in the patch wherein the patch is oriented with respect to the driven elements so that the beam width of one resonant mode is varied substantially more than the beam width of the other resonant mode due to the geometry of the patch.

2. A radiating element as claimed in claim 1 wherein the beam width of one resonant mode is varied substantially independently of the other resonant mode.

3. A radiating element as claimed in claim 1 wherein the patch has only first order symmetry.

4. A radiating element as claimed in claim 1 wherein the patch includes two planar portions disposed at an angle to one another.

5. A radiating element as claimed in claim 1 wherein the angle between the planar portions is between 135° to 178°, and preferably between 150° to 175°.

6. A radiating element as claimed in claim 1 including a further patch spaced apart from the patch and having the same general cross-sectional profile as the patch.

7. A radiating element as claimed in claim 6 wherein both patches include two planar portions disposed at an angle to one another arranged so that the fold lines of the planar portions of each patch are substantially aligned.

8. A radiating element as claimed in claim 7 wherein the planar portions of the further patch are disposed at an angle to each other that is smaller than the angle at which the planar portions of the patch are disposed to each other.

9. A radiating element including a patch and auxiliary elements fed directly from a central region of the patch.

10. A radiating element as claimed in claim 9 wherein the auxiliary elements are fed by way of microstrips electrically connected between the patch and the auxiliary elements.

11. A radiating element as claimed in claim 10 wherein two orthogonal resonant modes are excited in the patch and the microstrips are connected to the patch so as to feed one resonant mode to the auxiliary elements substantially more than the other mode.

12. A radiating element as claimed in claim 10 wherein the microstrips are substantially one half wavelength long at the frequency of operation of the radiating element.

13. A radiating element as claimed in claim 10 wherein auxiliary elements are provided adjacent opposite sides of the patch generally in the plane of the patch.

14. A radiating element as claimed in claim 13 wherein a further patch is provided spaced apart from and above the patch.

15. A radiating element comprising:

a ground plane;

a first patch spaced apart from the ground plane;

a second patch provided spaced apart from the ground plane and a first edge of the first patch; and a first driven element positioned between the first patch and the second patch to excite both the first patch and the second patch in a first resonant mode.

16. A radiating element as claimed in claim 15, further including:

a third patch provided spaced apart from an edge of the first patch opposite to the first edge of the first patch; and a second driven element positioned between the first patch and the second patch to excite the first patch and the third patch in a first resonant mode.

17. A radiating element as claimed in claim 16, further including a third driven element positioned to excite a second resonant mode in the first patch that is orthogonal to the first resonant mode excited by the first and second driven elements.

18. A radiating element as claimed in claim 15, wherein the first, second and third driven elements are aperture fed radiating elements.

19. A radiating element as claimed in claim 15, wherein the third driven element is substantially centrally located with respect to the patch.

20. A radiating element as claimed in claim 15, wherein a further patch is provided spaced apart from and above the first patch.

21. A radiating element as claimed in claim 20, wherein the further patch is a non-planar patch.

22. A radiating element as claimed in claim 21, wherein the first and further patches each includes two planar portions disposed at an angle to one another which are substantially aligned along their fold lines.

23. A radiating element as claimed in claim 20, wherein parasitic elements are provided spaced apart above the second and third patches substantially in the plane of the further patch.

24. A radiating element as claimed in claim 15, wherein slots are provided in the edges of the first patch remote from the second and third patches to increase coupling between the first patch and the ground plane.

25. A radiating element, comprising:

a driven element, a ground plane adjacent the driven element having an aperture, and a lower patch, driven by the driven element, having notches in the edges thereof positioned to increase coupling with the aperture.

26. A radiating element as claimed in claim 25, wherein the notches are provided on opposite sides of the lower patch.

27. A radiating element as claimed in claim 25, further including an upper patch spaced from the lower patch, wherein the notches are positioned to reduce the coupling between the upper and lower patches.

28. A radiating element as claimed in claim 25, wherein the lower patch is rectangular and parasitic elements are provided adjacent and spaced apart from edges of the lower patch that have no notches therein.

* * * * *